United States Patent [19]

Epps

[11] 4,112,281

[45] Sep. 5, 1978

[54] COMBINED WATER HEATER AND SAUNA ROOM HEATER DEVICE

[75] Inventor: L. Macon Epps, Huntington, N.Y.

[73] Assignee: The Raymond Lee Organization, Inc., New York, N.Y. ; a part interest

[21] Appl. No.: 674,771

[22] Filed: Apr. 8, 1976

[51] Int. Cl.[2] ..... F24D 3/08; F24H 1/18; A61H 33/06; H05B 1/00

[52] U.S. Cl. ..... 219/283; 4/160; 126/101; 126/361; 219/312; 219/341; 219/361; 219/362; 219/365; 219/377; 219/474; 219/475; 237/19

[58] Field of Search ..... 219/310, 312, 283, 341, 219/311, 362, 360, 365, 366-370, 377, 475, 476, 474; 4/160-164; 237/19, 49; 126/101, 361

[56] References Cited

U.S. PATENT DOCUMENTS

| | | | |
|---|---|---|---|
| 2,084,287 | 6/1937 | Hamdley | 219/311 X |
| 2,643,323 | 6/1953 | Carlson et al. | 219/283 |
| 2,786,653 | 3/1957 | Martin | 126/101 |
| 3,299,443 | 1/1967 | Ketola | 4/160 |
| 3,358,118 | 12/1967 | Mather et al. | 219/311 |
| 3,381,108 | 4/1968 | Wuck | 219/366 X |
| 3,422,465 | 1/1969 | Jones et al. | 219/362 X |
| 3,767,894 | 10/1973 | Berger | 219/365 X |

*Primary Examiner*—A. Bartis

*Attorney, Agent, or Firm*—Daniel Jay Tick

[57] ABSTRACT

A jacket of rigid thermal insulation, containing a thermally reflective coating on its inner surface, is movably mounted on a hot water tank (gas-, electric-, oil-, etc-fired, of either standard or special design) mounted in a sauna room and selectively covers the top and sides of the tank and extends to the supporting surface of the tank. The jacket is selectively movable to a closed position completely enclosing the tank and to an open position exposing part of the top, sides and bottom of the tank and part of the area between the supporting surface and the bottom of the tank. A perforated housing is provided in the area between the supporting surface and the bottom of the tank. Sauna rocks and electric heating elements are provided in the perforated housing. An electric fan is mounted in the area for directing hot air from the housing upward around the tank. A circuit includes a jacket switch arranged to be closed when the jacket is in the open position and open when the jacket is in the closed position and a sauna room thermostat, and electrically connects the switch, the thermostat, the heating elements and the fan in circuit to energize the heating elements and the fan when the switch is closed. The sauna room thermostat cycles the fan and heating element ON and OFF to maintain the desired, preset sauna room temperature.

4 Claims, 5 Drawing Figures

COMBINED WATER HEATER AND SAUNA ROOM HEATER DEVICE

BACKGROUND OF THE INVENTION

The present invention relates to a combined hot water and sauna heater device.

Most households in industrialized nations have hot water heaters, whose purpose is to supply water at approximately 160° F. on demand of the user. These heaters typically store the heated water in insulated tanks of 30 or more gallons capacity, and maintain the desired water temperature by thermostatic control. Energy sources used are electricity, gas, fuel oil, and, recently, solar heat. Hot water heaters have been mass produced in large quantities for many years.

Sauna heaters are used in homes, health clubs, recreation facilities, etc, by those people who wish to avail themselves of sauna baths— 10 to 20 minutes exposure to elevated ambient temperatures of 160° F. or more—for health, weight loss, or general conditioning reasons. Sauna heaters are typically metal enclosures, containing sauna rocks, electric heating elements circulating fans and controls, and frequently cost more to purchase and install than hot water heaters. They are produced in quantity, but nowhere near that of hot water heaters.

This invention proposes to utilize the inherent heating qualities and control features of hot water heaters to provide the primary heat source for a sauna bath by locating the water heating tank in a sauna room and to supplement this heat and control the sauna room temperature by adding a low cost auxiliary heater, fan and controls as described herein. The total cost of the combined hot water and auxiliary heater will obviously be much less than the cost of separate units fulfilling separate functions and requiring separate installations.

Objects of the invention are to provide a combined hot water and sauna heater device of simple structure, which is inexpensive in manufacture, and functions efficiently, effectively and reliably, permitting the heat produced in a hot water tank and a separate electrically heated housing containing sauna rocks to be selectively directed to heat a sauna room to the desired temperature.

Further objects of the invention are to reduce the acquisition, installation, and operating cost as compared to two separate insulated tank-type units, i.e. a separate hot water heater and a separate sauna heater; to reduce a time required to heat the sauna room by virtue of the rapid transfer of the large quantity of heat from the heated water normally stored in the tank, via radiation and convection upon moving the tank insulation to an open position exposing part of the tank; and to reduce the space required in the dwelling or building as compared to two separate units.

Another object is to provide protection to sauna bathers from accidental contact with hot elements, without adding the usual barriers or guards found in conventional sauna heaters, by virtue of the fact that the tank insulation shields much of the heated tank surface and the higher temperature housing is located near the floor and within the plan view envelope of the tank.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 2:
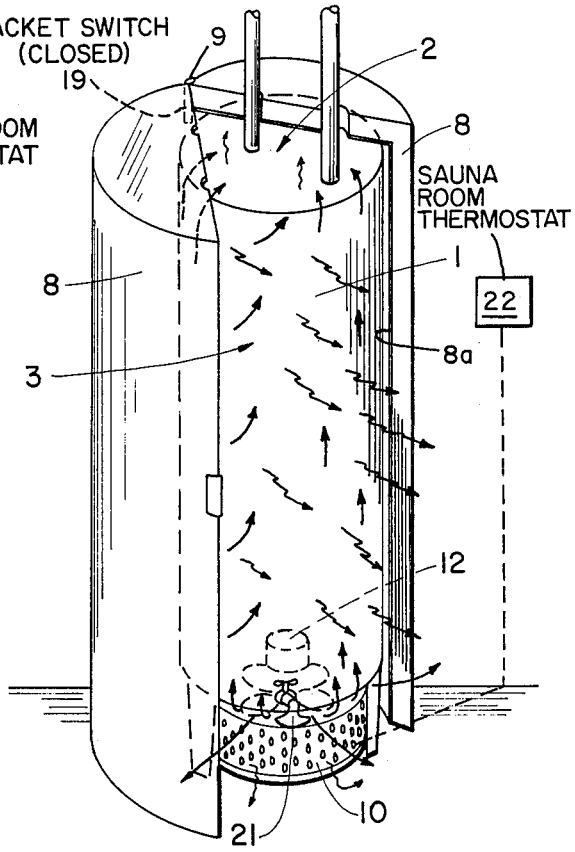
FIG. 2 is a perspective view of the embodiment of FIG. 1 in operating condition as a sauna heater.
Figure 3:
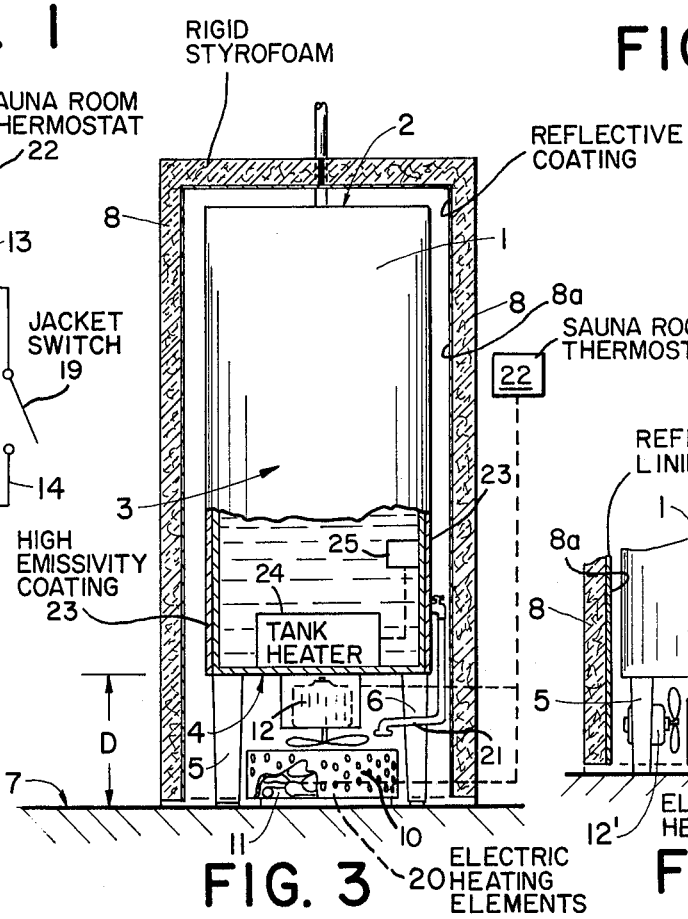
FIG. 3 is a view, partly in section taken along the lines III—III, of FIG. 1.

The combined hot water and sauna heater device of the invention comprises a hot water heating unit (gas-, electric-, oil-, etc-fired of standard or special design) mounted in a sauna room and including a water tank 1 (FIGS. 2, 3 and 5), preferably coated with a high thermal emissivity finish 23 (see FIG. 3), having a top 2, sides 3 and a bottom 4 (FIG. 3). A plurality of legs 5, 6, and so on (FIGS. 3 and 5) support the tank 1 at a predetermined distance D above a supporting surface 7 (FIG. 3).

The hot water in the tank provides the base temperature for the sauna room. Peak temperature is provided on demand by the auxiliary heater located beneath the tank. The magnitude of auxiliary heater power required depends upon the size and insulation of the sauna room and the maximum temperature desired, and is considerably less than for a conventional sauna heater operating by itself.

A jacket 8 (FIGS. 1, 2, 3 and 5) of substantially rigid thermal insulation of any suitable known type such as, for example, styrofoam, and having a thermally reflective coating 8a on its inner surface (FIGS. 2, 3, and 5), is movably mounted on the tank 1 and selectively covers the top 2 and the sides 3 of the tank and extends to the supporting surface 7. The jacket 8 is selectively movable via a pivot device 9 (FIG. 1) to a closed position, shown in (FIGS. 1 and 2) between completely enclosing the tank 1, and an open position, shown in FIG. 2, exposing part of the top 2, sides 3 and bottom 4 of the tank and part of the area between the supporting surface 7 and said bottom of said tank.

The auxiliary heater comprises a perforated housing 10 (FIGS. 1 to 3 and 5) provided in the area between the supporting surface 7 and the bottom 4 of the tank 1. Sauna rocks 11 (FIG. 3) and electric heating elements 20 (FIGS. 3–5) are provided in the perforated housing 10.

An electric fan 12 of any suitable type is mounted in the area for directing heated air via a forced draft from the rocks 11 and housing 10 upward past the tank 1 into the sauna room, picking up further heat during its passage from the heated tank 1.

Figure 1:
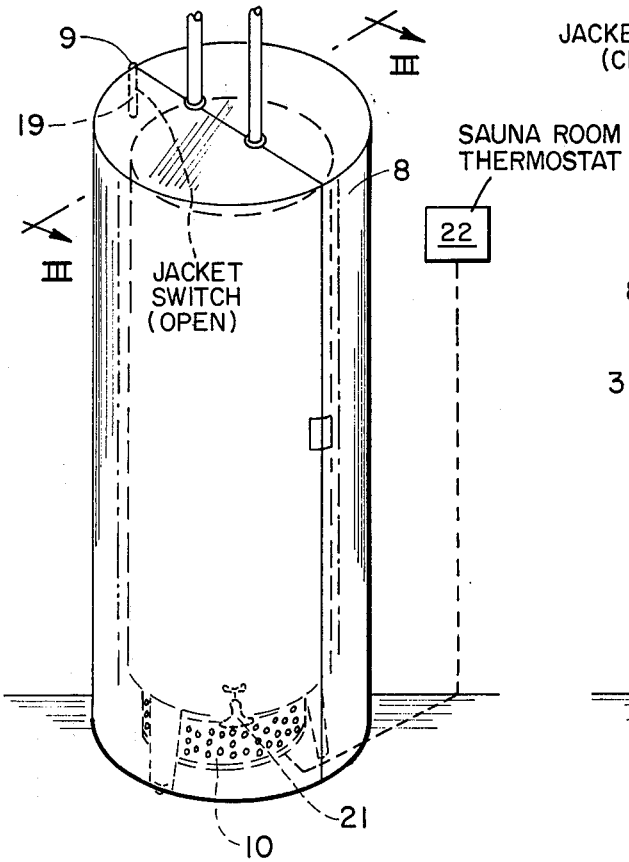
FIG. 1 is a perspective view of an embodiment of the combined hot water and sauna heater device of the invention in nonoperating condition as a sauna heater.
Figure 5:
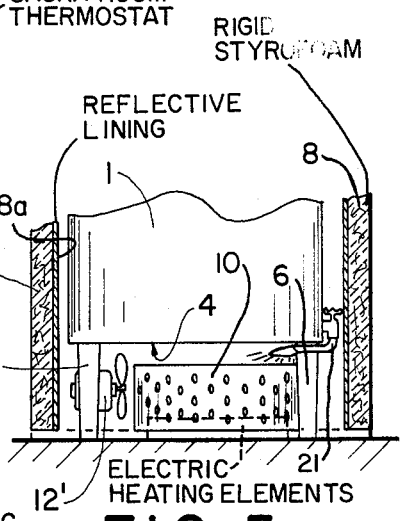
FIG. 5 is a cutaway view, partly in section, of part of a modification of the combined hot water and sauna heater device of the invention.

In the embodiment of FIGS. 1 to 3, the fan 12 is coaxially mounted at the bottom 4 of the tank 1. In the modification of FIG. 5, the fan 12' is mounted on a leg 5 of the tank 1. Both the fan and the housing 10 and its contents 11 and 20 could be mounted on the top of the tank in an arrangement similar to that shown in the embodiment of FIGS. 1 to 3 and the modification of FIG. 5.

Figure 4:
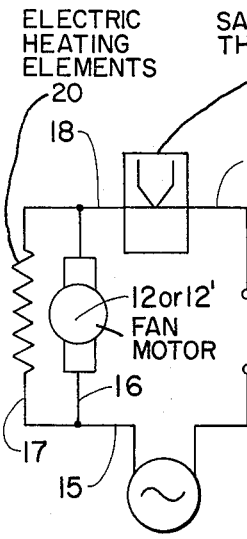
FIG. 4 is a circuit diagram of the combined hot water and sauna heater device of the invention.

A circuit 13, 14, 15, 16, 17, 18 includes a switch 19 and sauna room thermostat 22, and electrically connects said switch and thermostat to electric heating elements 20 (FIGS. 3 and 4) of any suitable type in the perforated housing 10, and the fan 12 or 12' in circuit, as shown in FIG. 4, to energize the heating elements and fan when the thermostat 22 and switch 19 are closed. The thermostat cycles the fan and heating elements ON and OFF to maintain the preset sauna room temperature desired by the user and is responsive to the temperature of the sauna room.

In a preferred embodiment of the invention, the switch 19 is coupled to the jacket 8 in a manner whereby when said jacket is moved to its open position as shown in FIG. 2, said switch is automatically closed, thereby energizing the heating elements 20 and the fan 12 or 12'.The switch 19 is open when the switch jacket is in the closed position shown in FIG. 1.

A water pipe and valve 21 (FIGS. 1, 2 and 5) extends from the tank 1 to the perforated housing 10 for selectively supplying water to the sauna rocks 11 in said housing thereby providing the desired ingredients of a sauna heater.

A thermally high emissivity coating 23 is provided on the external surface of at least the exposed part of the tank 1, as shown in FIG. 3, to maximize the heat radiated into the sauna room from the heated tank when the jacket 8 is in its open position.

The interior of the tank 1 contains the usual heating means 24 and thermostatic controls 25 to operate automatically and maintain the water at the preset temperature.

The sequence of steps in using the device of the invention to heat a sauna room is as follows:

1. The user sets the sauna room thermostat 22 to a desired temperature.

2. The user opens the jacket 8. This automatically makes heat from the hot water tank 1 immediately available to the sauna room through radiation and natural convection. The switch 19 is automatically closed when the jacket is opened, thereby activating the electric heating element 20 and the fan 12 or 12', which are controlled by the sauna room thermostat. Normally, operation is continuous until the desired elevated room temperature is reached, at which time the heating elements 20 and fan 12 or 12' cycle ON and OFF via the sauna room thermostat to maintain the room temperature within preset limits. Throughout the entire sequence, the hot water tank automatically maintains domestic hot water at the desired temperature via the thermostatic control 25 common to hot water heaters.

3. During the sauna bath, the user can select the desired blend of temperature and humidity by adjusting the sauna room humidity via the water pipe and the valve 21, and the room temperature via the sauna room thermostat 22.

4. When the sauna bath is over, the user closes and latches the jacket 8, which automatically maintains the thermal energy in the hot water tank within said jacket in the usual manner. When the jacket 8 is closed, the switch 19 is automatically opened and halts the flow of electric current to the heating elements 20 and the fan 12 or 12'.

While the invention has been described by means of a specific example and in a specific embodiment, I do not wish to be limited thereto, for obvious modifications will occur to those skilled in the art without departing from the spirit and scope of the invention.

I claim:

1. In combination with a sauna room, a combined domestic hot water and sauna room heater device mounted in said sauna room, said device comprising a domestic hot water heating unit including a water tank having a top, sides and a bottom and leg means supporting the tank with its bottom at a predetermined distance above a supporting surface in said sauna room, said tank having a cold water inlet means and a hot water outlet for connection to a domestic hot water system of a building, said tank including thermostatically controlled heating means for heating the water therein to a predetermined temperature;

a split jacket of substantially rigid thermal insulation movably mounted about the tank and selectively covering the top and sides of the tank and extending to the supporting surface, said jacket being selectively movable between a closed position completely enclosing and insulating the tank and an open position exposing part of the top, sides and bottom of the tank and part of the area between the supporting surface and the bottom of the tank, the exposed part of the tank serving as a heat exchange surface for radiating heat from the hot water in the tank to the sauna room;

a separate perforated housing mounted within said jacket in the area between the supporting surface and the bottom of the tank;

sauna rocks in the perforated housing;

electric heating means in the perforated housing for heating the sauna rocks;

electric fan means mounted in said area for directing heated air via forced draft from the housing upward past the exposed part of said tank to pick up additional heat therefrom and thence into the sauna room;

circuit means including switch means and a thermostat means responsive to sauna room temperature, said switch means and thermostat means being electrically connected to the heating means and the fan means to energize the heating means and fan means when the switch means is closed and when said sauna room is below the desired temperature for maintaining desired sauna room temperature under the control of said thermostat means, said switch means being coupled to the jacket in a manner whereby when the jacket is moved to its open position said switch means is automatically closed to energize the electric heating means and fan means, said switch means being open when said jacket is in its closed position; and selectively operable means associated with said tank for supplying water from the tank to the heated rocks in the perforated housing for generating steam in the sauna room.

2. A combined hot water and sauna heater device as claimed in claim 1, wherein said means for selectively supplying water comprises water pipe and valve means extending from the tank to the perforated housing for selectively supplying water to the sauna rocks in said housing.

3. A combined hot water and sauna heater device as claimed in claim 1, further comprising a thermally reflective coating on the inner surface of the jacket to minimize heat loss from the tank when the jacket is in its closed position, and maximize heat transfer to the room from the exposed part of the tank when the jacket is in the open position.

4. A combined hot water and sauna heater device as claimed in claim 1, further comprising a thermally high emissivity coating on the external surface of at least the exposed part of said tank to maximize the heat radiated into the sauna room from the heated tank when the jacket is in its open position.

* * * * *